US006579335B2

(12) United States Patent
Ollinger

(10) Patent No.: US 6,579,335 B2
(45) Date of Patent: Jun. 17, 2003

(54) OIL SEPARATOR AND COOLER

(76) Inventor: Walter Duane Ollinger, P.O. Box 478, Dumas, TX (US) 79029

( * ) Notice: Subject to any disclaimer, the term of this patent is extended or adjusted under 35 U.S.C. 154(b) by 0 days.

(21) Appl. No.: 10/236,653

(22) Filed: Sep. 6, 2002

(65) Prior Publication Data

US 2003/0005667 A1 Jan. 9, 2003

Related U.S. Application Data

(62) Division of application No. 09/694,579, filed on Oct. 23, 2000, now Pat. No. 6,521,023.

(51) Int. Cl.[7] ..... B01D 45/12; F04C 18/00

(52) U.S. Cl. ..... 55/459.1; 96/188; 166/267; 418/55.6

(58) Field of Search ..... 166/267; 95/261, 95/271; 55/459.1; 96/188; 418/55.6

(56) References Cited

U.S. PATENT DOCUMENTS

| | | | | | |
|---|---|---|---|---|---|
| 2,828,818 | A | | 4/1958 | Wright | 166/8 |
| 3,358,763 | A | | 12/1967 | Petty et al. | 166/42 |
| 3,443,641 | A | | 5/1969 | McComb | 166/302 |
| 3,709,292 | A | | 1/1973 | Palmour | 166/68 |
| 4,437,813 | A | * | 3/1984 | Ingram | 417/53 |
| 5,146,987 | A | | 9/1992 | Krieg | 166/302 |
| 5,382,141 | A | | 1/1995 | Stinessen | 417/423.8 |
| 5,450,901 | A | | 9/1995 | Ellwood | 166/266 |
| 5,460,227 | A | | 10/1995 | Sidrim | 166/357 |
| 5,477,924 | A | | 12/1995 | Pollack | 166/357 |
| 5,531,811 | A | | 7/1996 | Kloberdanz | 95/261 |
| 5,857,522 | A | | 1/1999 | Bradfield et al. | 166/267 |
| 6,058,727 | A | * | 5/2000 | Fraser, Jr. et al. | 62/190 |
| 6,257,840 | B1 | * | 7/2001 | Ignatiev et al. | 417/310 |

* cited by examiner

*Primary Examiner*—Robert A. Hopkins
(74) *Attorney, Agent, or Firm*—Wendell Coffee

(57) ABSTRACT

Oil which has been heated by use in a gas compressor is cooled by transferring the heat from the oil to gas upstream from the compressor. Specifically, the hot oil and gas leaving the compressor are separated by feeding the oil-gas mixture along a tangent of a cylindrical chamber. The oil drops through holes in the bottom of the chamber into a upper reservoir. The oil flows from the upper reservoir into a tube which extends through a heat exchange having cold natural gas outside the tube. The oil flows from the tube into a lower reservoir and from there into the compressor.

4 Claims, 1 Drawing Sheet

OIL SEPARATOR AND COOLER

CROSS REFERENCE TO RELATED APPLICATION

This is a Divisional Patent Application from the Patent Application entitled Oil Separator and Cooler, filed on Oct. 23, 2000, application Ser. No. 09/694,579, now U.S. Pat. No. 6,521,023. Restriction was required by the Examiner Dec. 26, 2001.

BACKGROUND OF THE INVENTION (1) Field of the Invention

This invention relates to compressing natural gas for transportation in pipe lines. Managers of compression units have ordinary skill in this art.

(2) Description of the Related Art

The general practice of transporting natural gas from a well includes compressing the gas from the pressure it has at the well head to a high pressure for transportation to the point of usage. The equipment to perform this task is usually a liquid ring compressor or a screw compressor which are widely used and well known in the art. Characteristic of these compressors is that the compressor has an oil seal.

It is necessary in the operation of an oil seal compressor to cool the oil. Some of the oil will mix with the compressed gas at high temperatures. The oil is separated from the compressed gas before the gas enters the pipe line. It is standard practice in compression units to have a mechanical refrigeration unit to cool the seal oil after it has been separated from the compressed gas and before it is reintroduced into the compressor.

The refrigeration units add to the capital investment and the operation increase the cost of operating the compression unit. Also it is an additional piece of machinery which requires the normal maintenance and the other operation attention of personnel.

SUMMARY OF THE INVENTION (1) Progressive Contribution to the Art

According to this invention the hot separated seal oil is fed through a heat exchanger which transfers the heat of the oil into the cold gas coming from the well. The natural gas is cold because of its expansion from the deposit within the earth to the intake of the compressor.

The oil is cooled in the exchanger without mechanical machinery.

The oil is separated from the gas in part by slinging the oil outward in a centrifugal fashion.

The heat transferred from the seal oil to the gas entering the compression increases the gas temperature. This increase in temperature will require more energy to compress the gas to the pipeline pressure. However the ability to avoid the initial cost of the refrigeration equipment and the normal expense necessary for workman to monitor the refrigeration equipment makes the operation advantageous over mechanical refrigeration. There will also be a slight pressure drop of the gas from the well because of the turbulence caused by the gas circulating in the heat exchanger. However; the advantages out weigh this disadvantages also.

(2) Objects of this Invention

An object of this invention is to simplify the process of cooling seal oil at gas compression units.

Another object of this invention is to use the natural resulting low temperature of the gas entering the compressor as a source of cooling for the seal oil used in the compressors.

Another object is to simplify the separation of the oil from the compressed gas.

Further objects are to achieve the above with devices that are sturdy, compact, durable, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

CATALOGUE OF ELEMENTS

As an aid to correlating the terms of the claims to the exemplary drawing(s), the following catalog of elements and steps is provided:

| | |
|---|---|
| 12 | Inlet |
| 14 | Separator |
| 16 | Heat Exchanger |
| 18 | Lower Reservoir |
| 19 | Hot oil Conduit |
| 28 | Compressor |
| 30 | Compress out pipe |
| 32 | Filter |
| 34 | Pipeline |
| 36 | Oil Pipe |
| 42 | Upper Reservoir |
| 210 | Tank |
| 214 | Separator |
| 215 | Separator Radial Line |
| 216 | Heat Exchanger |
| 218 | Collection Reservoir |
| 220 | Top Plate |
| 221 | Tangent Line |
| 222 | Bottom Plate |
| 224 | Coils |
| 230 | Separator Inlet Pipe |
| 232 | Filter |
| 234 | Pipeline |
| 236 | Oil Pipe |
| 238 | Valve |
| 240 | Perforated Plate |
| 242 | Upper Reservoir |
| 244 | Oil Drain |
| 246 | Concentrate Drain |
| 248 | Sight Glass |

DESCRIPTION OF THE PREFERRED EMBODIMENTS

Figure 1:
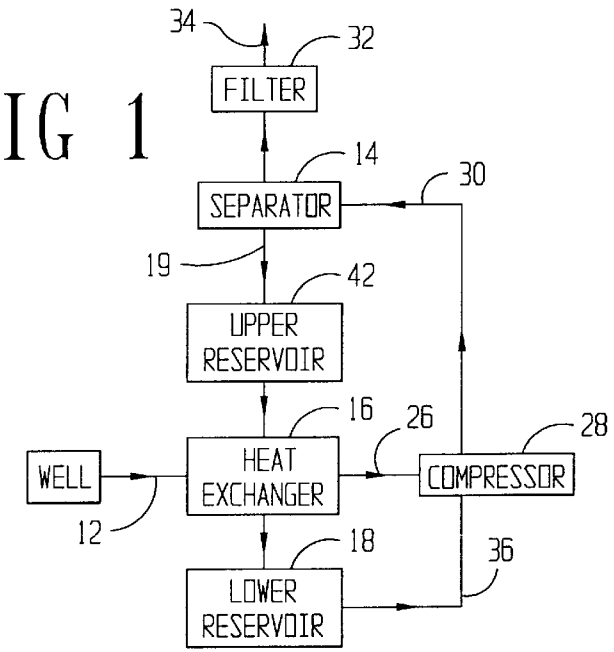
FIG. 1 is schematic representation of the invention.

Referring to FIG. 1 the drawings, it may be seen that gas enters a heat exchanger 16 by pipe 12 from a production well. The gas entering by pipe 12 will be cold.

The cold gas will cool hot oil flowing through the heat exchanger. The oil is contained in one or more tubes in the heat exchanger 16. It is preferred that the heat exchanger has conventional design of a plurality of tubes within a vessel.

Heat exchanger of conventional design are readily available. It is preferred that the pressure loss of the gas flowing through the vessel be a minimum.

The gas departs from the heat exchanger vessel by outlet pipe 26. The outlet pipe 26 is also an inlet pipe connected to compressor 28. The compressor 28 compresses the gas to the desired pipeline pressure.

The compressed gas from the compressor is introduced through pipe 30 into separator 14 where the oil is separated from the gas. The separator 14 may be of conventional design. Such separators are well known and readily available.

With the oil separated, the compressed gas flows into distribution pipeline 34 to be distributed. A filter 32 is located between the separator 14 and the distribution pipeline 34 to prevent undesirable substances from entering the pipeline.

The oil separated from the gas flows into an upper reservoir 42 through hot oil conduit 19. There are no obstructions between the separator 14 and upper reservoir 42. Therefore the oil in the upper reservoir will be under distribution pipeline pressure. Preferably, the upper reservoir 42 is located directly above the heat exchanger 16.

The upper reservoir is connected to the tube or tubes in the heat exchanger 16 without obstruction. Therefore the oil flows freely through the heat exchanger 16 and is caught in lower reservoir 18. Then the oil is moved through oil pipe 36 to the compressor as is well known to the art.

A sight glass (not shown in FIG. 1) is connected from the upper to lower reservoir to indicate the amount of seal oil available. It is important that the compressor unit has an adequate supply of seal oil. It is desirable that there is seal oil in the upper reservoir 42 and is visible in the sight glass. Also an alarm (not shown) will be activated if the supply of oil is reduced to a critical amount.

Figure 3:
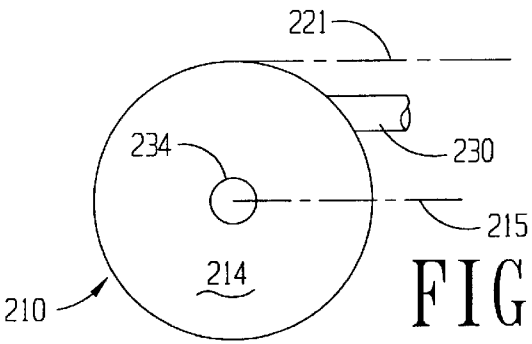
FIG. 3 is a sectional view taken on line 3—3 of FIG. 2.
Figure 2:
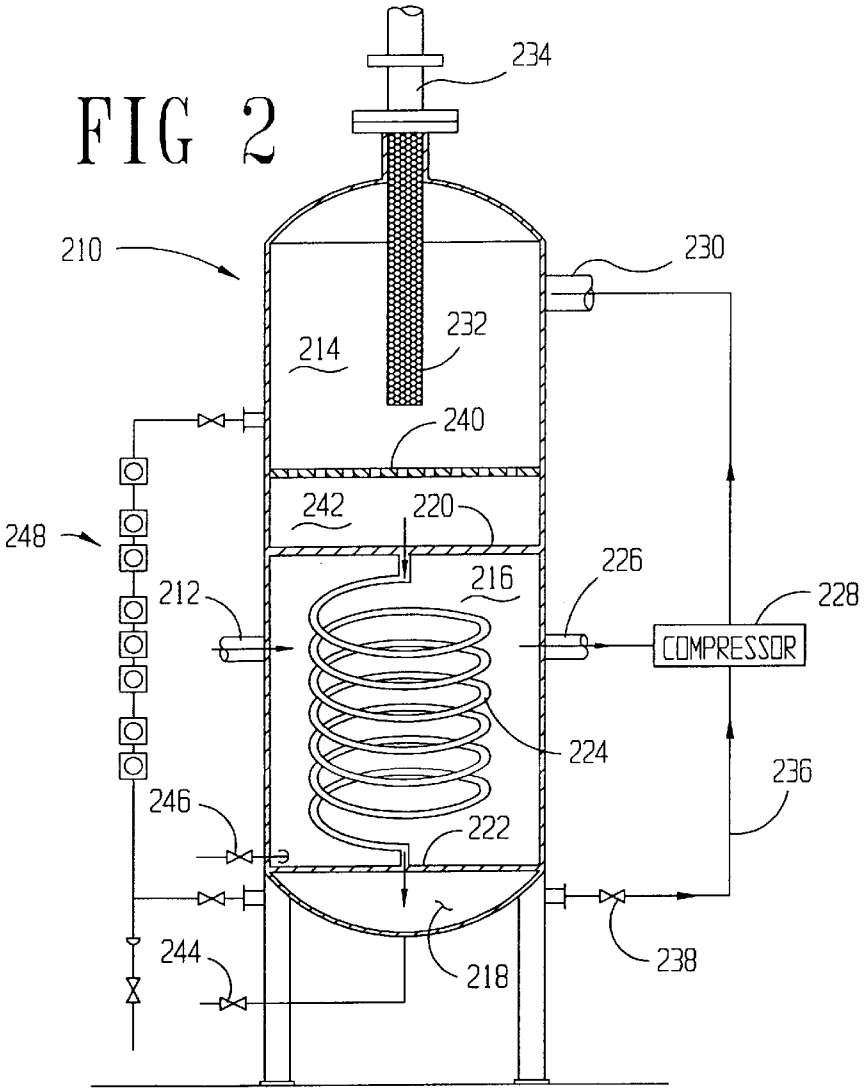
FIG. 2 is a representation of an arrangement of the elements of the invention.

As described above with FIG. 1 the object of cooling the seal oil by the incoming gas may be achieved by assembling well known elements. FIG. 2 and FIG. 3 with the following description, describe how the separator, reservoirs, and heat exchanger may be combined in a single upright tank 210.

The tank 210 is divided by two solid plates into three chambers. The upper chamber contains the separator 214 and the upper reservoir 242. The middle chamber contains the heat exchanger 216. The lower chamber is the oil collection reservoir 218. The three chambers are separated by top plate 220 and by bottom plate 222.

Referring to FIG. 3 it may be seen that the tank 210 and separator 214 is a cylinder having a separator axis. Separator inlet pipe 230 has inlet axis. Separator tangential line 221 is parallel to inlet axis and separator radial line 215 which radiates from the separator axis. The axis is closer to tangential line 221 than to radial line 215. This configuration results in the oil in the compressed gas to be slung against the cylindrical sides of the separator and to the bottom of the separation chamber 214. Filter 232 located in the separator 214 below the distribution pipeline 234 helps in preventing oil from going out with the gas in the pipeline 234.

Perforated plate 240 separates the separator 214 from the upper reservoir 242.

The oil will separate from the gas in the separator 214 and drain through the perforated plate 240 to the upper reservoir 242. The oil from the upper reservoir will exit through the plate 220 into coiled tube 224 and be cool therein. The oil is discharged from the coiled tube 224 thru the bottom plate 222 into the collection reservoir 218. In the event there is need to drain the oil, oil drain 244 is provided.

Condensate drain 246 drains any condensate from the chamber 216. It will be understood that the condensate drain is connected to a drain pump in as much as the middle chamber 216 might be below atmospheric pressure.

A series of sight glasses 248 are connected to the upper chamber 214 above the perforated plate 240 and to the lower chamber 218. To ensure the compressor 228 does not run low of seal oil, it is desired to keep the level in the upper reservoir 242 at least above half way between the plate 220 and the plate 240. Although not shown in the drawing there is an automatic cutoff in the event the oil level drops below this level. The cutoff would shut down the compressor 228.

It may be seen that the cold gas from the production well is used to cool the oil from the oil seals of the compressor. The natural refrigeration of the gas is used for this purpose thereby eliminating the need to use mechanical refrigeration. In the event too much seal oil is flowing through oil pipeline 236 the flow may be reduced by valve 238 in the oil pipeline adjacent the collection reservoir.

Also by consolidating the different equipment, into tank 210, the transition may be made by installing the tank 210 with its components.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to point out the advantages and the progressive contribution to the gas compression arts and to enable one skilled in the art to make and use the invention. The limits of the invention and the bounds of the patent protection are measured by and defined in the following claims.

I claim as my invention:

1. A system for cooling seal oil and compressing natural gas, the system comprising:

a) an oil seal compressor having a gas inlet and a gas outlet, b) the compressor having a cool oil intake and a hot oil outlet, c) a heat exchanger having a gas chamber, d) at least one tube extending through the gas chamber of the heat exchanger, e) a liquid inlet of the tube and a liquid outlet of the tube each accessible outside the gas chamber, f) a source of gas connected to a gas inlet of the gas chamber, g) the compressor gas inlet connected to an outlet of the gas chamber, and h) a conduit from the liquid outlet of the tube to the cool oil inlet of the compressor, and i) a connection from the compressor outlet containing hot oil to the liquid inlet of the tube.

2. A system for cooling seal oil and compressing natural gas, said system comprising:

a) a gas inlet pipe connected to a natural gas well and connected to a gas chamber of a heat exchanger, b) a heat exchanger outlet pipe connected to the gas chamber and to the inlet of a seal oil compressor, c) a compressor outlet pipe connected to the compressor to carry compressed gas and hot seal oil to a cylindrical gas-oil separation chamber, d) a seal oil tube in the heat exchange, e) means for feeding seal oil from the separation chamber to the tube, and f) means for feeding seal oil from the tube to the compressor.

3. The system as defined in claim 2 further comprising:

g) an upright tank containing the cylindrical gas-oil separation chamber above an upper reservoir which is above the heat exchanger, h) a collection reservoir below the heat exchanger, i) a top plate between the separation chamber and the heat exchanger, j) a bottom plate between the heat exchanger and the collection reservoir, k) the tube in the heat exchanger having access to the separation chamber through the top plate, and l) the tube having access to the collection reservoir through bottom plate.

4. The system as defined in claim 3 further comprising:

m) the outlet pipe is connected tangentially to the cylindrical separation chamber.

* * * * *